United States Patent [19]

Humphrey

[11] Patent Number: 4,660,025

[45] Date of Patent: Apr. 21, 1987

[54] ARTICLE SURVEILLANCE MAGNETIC MARKER HAVING AN HYSTERESIS LOOP WITH LARGE BARKHAUSEN DISCONTINUITIES

[75] Inventor: Floyd B. Humphrey, Bradfordwoods, Pa.

[73] Assignee: Sensormatic Electronics Corporation, Boca Raton, Fla.

[21] Appl. No.: 675,005

[22] Filed: Nov. 26, 1984

[51] Int. Cl.[4] ..... G08B 13/24

[52] U.S. Cl. ..... 340/572; 340/551

[58] Field of Search ..... 340/572, 551

[56] References Cited

U.S. PATENT DOCUMENTS

| | | | |
|---|---|---|---|
| 3,765,007 | 10/1973 | Elder | 340/572 |
| 4,075,618 | 2/1978 | Montean | 340/572 |
| 4,222,517 | 9/1980 | Richardson | 340/572 |
| 4,298,862 | 11/1981 | Gregor et al. | 340/572 |
| 4,484,184 | 11/1984 | Gregor et al. | 340/551 |
| 4,510,489 | 4/1985 | Anderson, III et al. | 340/551 |
| 4,510,490 | 4/1985 | Anderson, III et al. | 340/572 |

*Primary Examiner*—Glen R. Swann, III

*Attorney, Agent, or Firm*—Robin, Blecker & Daley

[57] ABSTRACT

A marker for an electronic article surveillance system is disclosed comprising a body of magnetic material with retained stress and having a magnetic hysteresis loop with a large Barkhausen discontinuity such that, upon exposure of the marker to an external magnetic field whose field strength in the direction opposing the instantaneous magnetic polarization of the marker exceeds a predetermined threshold value, there results a regenerative reversal of the magnetic polarization of the marker. An electronic article surveillance system and a method utilizing the marker are also disclosed. Exciting the marker with a low frequency and low field strength, so long as the field strength exceeds the low threshold level for the marker, causes a regenerative reversal of magnetic polarity generating a harmonically rich pulse that is readily detected and easily distinguished.

44 Claims, 23 Drawing Figures

Fig. 1.
(Prior Art)
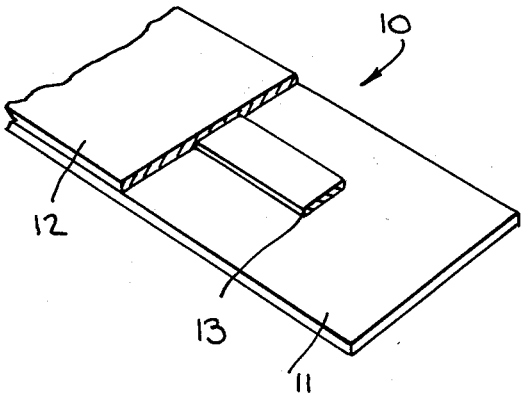
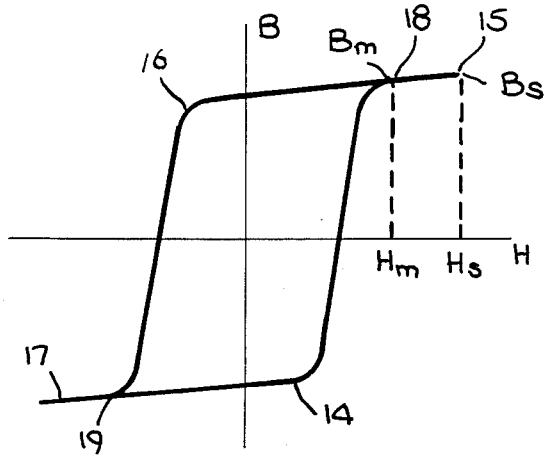
Fig. 2.
Fig. 3.
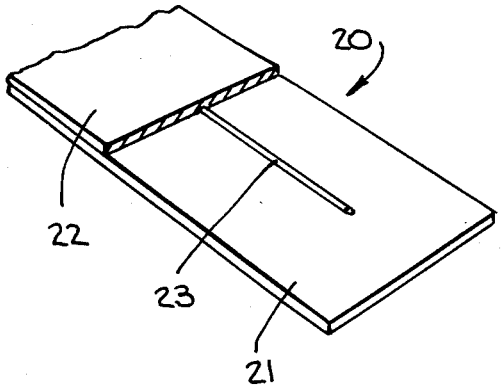
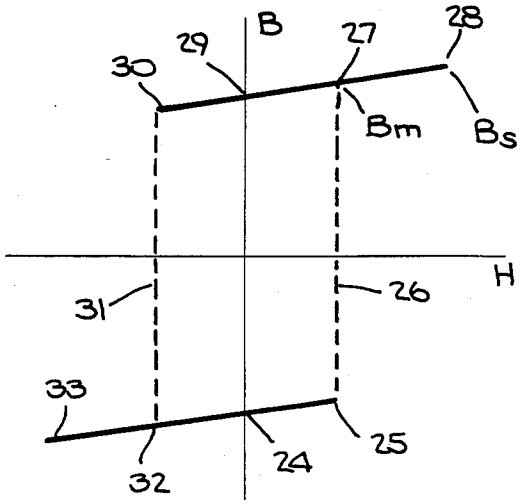
Fig. 4.
Fig. 5.
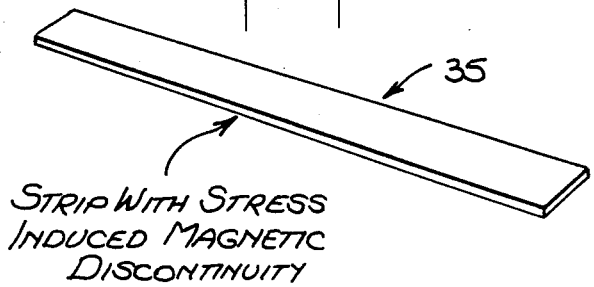

1.2 Oe 2.4 Oe 3.4 Oe 4.5 Oe
PERMALLOY - 60 Hz EXCITATION 1.2 Oe 2.4 Oe 3.4 Oe 4.5 Oe
"METGLAS" - 60 Hz EXCITATION 1.2 Oe 2.4 Oe 3.4 Oe 4.5 Oe
INVENTION 60Hz EXCITATION 1.20e Excitation At 20 Hz PRIOR ART STRIP-PERMALLOY-60 Hz EXCIT.

INVENTION - 60 Hz EXCIT.

PRIOR ART STRIP "METGLAS" - 60 Hz EXCIT.

ARTICLE SURVEILLANCE MAGNETIC MARKER HAVING AN HYSTERESIS LOOP WITH LARGE BARKHAUSEN DISCONTINUITIES

BACKGROUND OF THE INVENTION

The present invention relates to article surveillance and more particularly to article surveillance systems generally referred to as of the magnetic type.

In 1934 a French Pat. No. 763,681, was granted to Pierre Picard for a "Method for Locating Objects by Modifying a Magnetic Field." At the heart of the Picard system was the recognition that different samples of metallic material produced different harmonic signals when detected by an "electrodynamic balance," which different signals could be used to recognize one sample as distinct from another. The patent observes that a piece of copper will produce only a fundamental frequency component, while a piece of iron will produce a signal containing, in addition to the fundamental term, a certain number of harmonics. On the other hand, it also observes that metals with an initially very high permeability, such as mu metal or permalloy or permafy, also furnish harmonics, and the label, i.e., harmonic number, of these harmonics is much higher than in the case of iron. Therefore, by incorporating a suitable filter to detect a particular harmonic it is possible to recognize the presence of such high permeability material. As an example, Picard describes recognizing a piece of permalloy by detecting a 650 hertz component, i.e., the 13th harmonic, when the exciting field has a frequency of 50 hertz. At another point in the patent, Picard indicates that the third harmonic at 150 hertz is preferably employed.

Subsequent to Picard, a long list of patents have been issued on inventions seeking to improve upon the selectivity and reliability of systems intended to detect magnetic markers. These patents emphasize selecting suitable geometry coupled with low coercive force and high permeability in order to provide a distinctive and detectable signal. An extensive summary of these patents relating to magnetic marker detection will be found in Richardson, U.S. Pat. No. 4,222,517, issued Sept. 16, 1980. Said patent refers to a typical interrogation field as having a peak amplitude of approximately 1 Gauss varying at a frequency between 60 Hz and 10 kHz. The magnetic strip is identified as permalloy that has been annealed for maximum response with final coercivity of from 0.01 to 0.1 oersteds and a permeability on the order of 200,000 Gauss/Oersted. The dimensions of the strip are given as typically 3 inches long, 0.0007 inches thick and 0.125 inches wide. However, it is stated that the thickness and width can vary plus or minus 20 percent while the length can range from less than 2 inches to as much as 7 inches. Finally, Richardson asserts that the most accepted system design detects the 18th to 20th order harmonics of the fundamental interrogation frequency.

The Richardson patent contains extensive reference to U.S. Pat. No. 3,765,007, issued Oct. 9, 1973 to James T. Elder. In its "summary of the invention" section, the Elder patent describes the nature of the system contemplated for use with the markers described therein. In the words of the patent, the system comprises "equipment for applying in the [interrogation] zone a periodically varying magnetic field which increases at a predetermined time rate of change." The significance of this statement will become apparent during the subsequent description of the present invention.

For the marker, the Elder summary states, inter alia, that it may take the form of a thin, flat ferromagnetic ribbon or wire having a magnetic moment of at least 0.1 electromagnetic unit, while the ratio of the length to the square root of the cross-sectional area should be at least 150. This is stated as ensuring that self-demagnetizing field effects do not increase the switching field beyond 20 oersteds. It is also stated that "conductive wire markers should have a diameter of 10 to 300 microns." However, it should be noted that Elder describes his preferred embodiment as consisting of open-strip sections of "an annealed permalloy ribbon . . . about 25 microns thick, 18 centimeters long and 0.6 centimeter wide."

Also of background interest is the disclosure found in Montean U.S. Pat. No. 4,075,618, issued Feb. 21, 1978. In column 5 of that patent, commencing in line 3, the patentee considers the types of materials from which his marker can be constructed. For the purpose of producing "high order harmonics" (in excess of the twentieth order) the active portion of the marker is preferably formed of "very high permeability material such as Permalloy . . . having a coercivity of not greater than 0.5 oersted, and preferably having coercive forces in the range of 0.02 oersted." The patent continues with the recitation that "the actual permeability of such a material is desirably in the range of $10^6$," and goes on to identify other suitable materials, to wit: "Supermalloy, 'METGLAS', an amorphous metallic alloy having low coercive force and high permeability, manufactured by the Allied Chemical Company, and 'Mark II Permalloy' such as the manufactured by Carpenter Technology, Inc." This section of the patent concludes with the statement that "Permalloy which has been annealed after it has been fabricated into the desired shapes to further enhance the permeability may be particularly desired."

With the exception of "METGLAS", all of the materials mentioned in the previously identified prior patents have been crystalline. An additional discussion of the use of non-crystalline, i.e., amorphous, metal for article surveillance markers will be found an Gregor et al. U.S. Pat. No. 4,298,862, issued Nov. 3, 1981. The Gregor et al. patent includes a recitation that an amorphous marker is prepared by cooling a melt of the desired composition at a rate of at least about $10^5$ degrees C./sec employing well known quenching techniques.

All of the magnetic markers described in the prior art mentioned above have in common the fact that they cause a detectable perturbation to an incident magnetic field in the process of reversing magnetic polarity. When such material is driven around its hysteresis loop, particularly from one polarity to the opposite, a signal pulse is produced. The shape of this pulse is a function of the time it takes to reverse polarity, i.e., proceed from one saturation point to the other, or from a residual induction point to the reverse saturation point. This time element is a function of the time rate of change of the incident field between levels sufficient to effect such polarity reversal. Hence, the statement found in the Elder patent and quoted above.

All available evidence reveals consistent and continuous endeavor to find materials with higher and higher permeability and lower and lower coercivity. The object of such endeavor has been to find markers that produce high order harmonics with sufficient amplitude to be readily detectable. With the same object in view, systems have been designed to operate at relatively high frequencies and/or with strong incident fields, and the latter has been attained generally by establishing narrow surveillance zones to limit the distance from marker to antenna.

In spite of the many years of effort obviously devoted to the problem, and some 50 years after Picard, none of the markers heretofore known has been able to produce in response to a surveillance field interrogation a signal sufficiently unique that the marker is free from being mimicked by at least some commonplace article. For example, certain samples of nickel plating have been known to produce signals containing harmonic components that cause false alarms in systems designed to detect permalloy markers.

It is with the above in mind that it is an object of the present invention to provide a marker having a unique characteristic enabling it to be detected without fear of false alarms from any presently known commonplace article.

It is a further object of the present invention to provide a surveillance marker whose response to an interrogating field is essentially independent of the time rate of change of the incident field.

A further object of the present invention is to provide such marker whose response is substantially independent of the incident field strength so long as such strength exceeds some low threshold level.

Another object of the present invention is to provide a surveillance marker with a magnetically interrogatable element that has a unique response characteristic notwithstanding that such element does not rely upon having high permeability and low coercivity. A corollary to this objective is that such unique response is readily obtainable with sufficient amplitude to be detected readily.

SUMMARY OF THE IVNENTION

The present invention makes use of the phenomenon manifested by certain bodies of magnetic material under certain circumstances whereby, upon being subjected to an incident magnetic field, the body experiences a reversal of magnetic polarity that occurs in a regenerative fashion, i.e., with a large Barkhausen discontinuity in its hysteresis loop. More specifically, in accordance with the invention, there is provided a marker for use in an article surveillance system in which an alternating magnetic field is established throughout a surveillance region and an alarm is activated when a predetermined perturbation to said field is detected, said marker consisting of a body of magnetic material having a magnetic hysteresis loop with a large Barkhausen discontinuity such that exposure of said body to an external magnetic field, whose field strength in the direction opposing the instantaneous magnetic polarization of said body exceeds a predetermined threshold value, results in regenerative reversal of said magnetic polarization, and means for securing said body to an article to be maintained under surveillance.

BRIEF DESCRIPTION OF THE DRAWINGS

The invention will be better understood after reading the following detailed description of the presently preferred embodiments thereof with reference to the appended drawings in which:

FIG. 1 is a perspective view with portions broken away of a typical prior art magnetic marker;

FIG. 2 is a typical hysteresis curve illustrative of the magnetic characteristics of the marker of FIG. 1;

FIG. 3 is a view similar to FIG. 1, but showing a marker in accordance with the present invention;

FIG. 4 is a hysteresis curve illustrative of the magnetic characteristics of the marker of FIG. 3;

FIG. 5 is a perspective view of a ribbon of magnetic material that has been specially processed to produce at least one Barkhausen discontinuity in its hysteresis loop and which represents another embodiment of the present invention;

The same reference numerals are used throught the drawings to designate the same or similar parts.

DETAILED DESCRIPTION OF THE PRESENTLY PREFERRED EMBODIMENTS

Figures 6A, 6B, 6C, 6D, 7A, 7B, 7C, 7D, 8A, 8B, 8C, 8D:
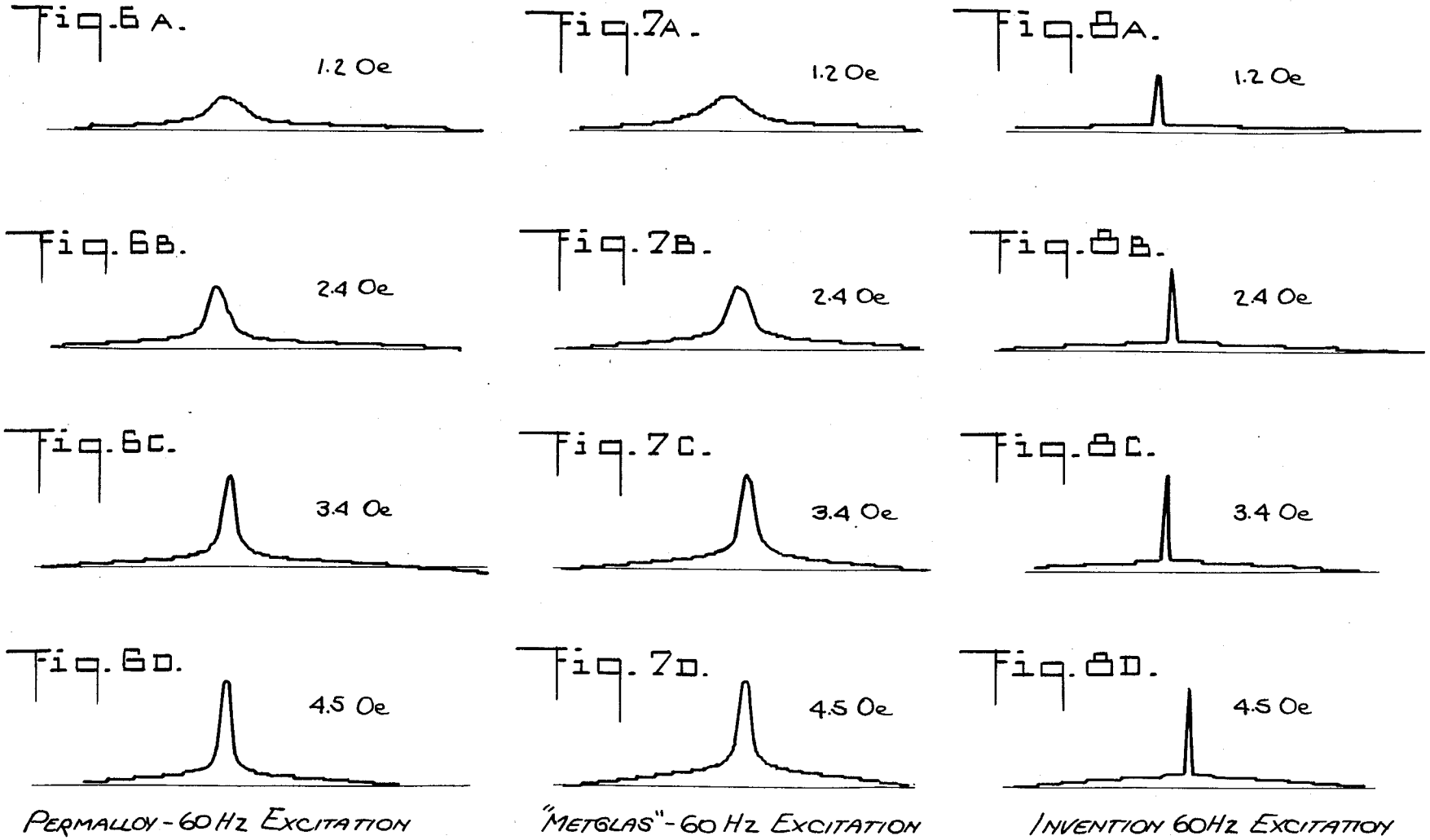
PRIOR ART Fig. 7A.
PRIOR ART Fig. 8A.
FIGS. 6A–6D are a series of four curves showing the pulse response to external excitation as obtained from a marker such as that of FIG. 1, when constructed of permalloy, in response to four different levels of field excitation.
FIGS. 7A–7D are a series of four curves, similar to those of FIG. 6, but for the marker of FIG. 1 when constructed of "Metglas" ductile amorphous metal ribbon.
FIGS. 8A–8D are a series of four curves, similar to those of FIG. 6, showing for purpose of comparison the response of a marker in accordance with the invention to the same four levels of field excitation.

Referring now to FIG. 1, a typical prior art marker designated generally by the reference numeral 10, is shown as consisting of a substrate 11 and an overlayer 12 between which is sandwiched and concealed a length of ribbon 13 of high permeability magnetic material. The undersurface of the substrate 11 can be coated with a suitable pressure sensitive adhesive for securing the marker to an article to be maintained under surveillance. Alternatively, any other known arrangement can be employed to secure the marker to the article. In this particular example, which was used to obtain the reference test data to be discussed below, the ribbon 13 was formed from 4-79 Molybdenum Permalloy 0.100" wide, 0.001" thick, and 3.0" long. It had a coercivity, $H_c$, of 0.05 oersteds, and a permeability at 100 Hz of 45,000 to 55,000.

The hysteresis loop or curve of the ribbon 13 is shown in rather general terms in FIG. 2. No attempt has been made to draw the loop to any type of scale or in scale proportions for such curve would appear very tall along the B axis and very narrow along the H axis. What is significant is that the curve between the knee at 14 and positive saturation at 15, as well as from the knee 16 down to the negative saturation point at 17, has a finite slope less than infinite. In order to reverse the magnetic polarity of the ribbon 13 it is necessary to subject it to an external field of at least $H_m$ to bring the material to at least its maximum induction point 18. The speed with which this can be accomplished is a direct function of the rate of change of the incident magnetic field, and the rate of change is proportional to both the frequency and the peak amplitude of such incident field.

In order to illustrate this effect, the sample described with reference to FIG. 1 was subjected to a 60 Hz field of selectable intensity, and a curve tracer was employed to obtain a plot of the pulse thereby produced when the ribbon 13 reversed polarity. FIG. 6A shows the wave shape in response to a 1.2 oersteds field, while FIGS. 6B, 6C and 6D show the effect of increasing the field strength, respectively, to 2.4, 3.4, and 4.5 oersteds.

In like manner, a ribbon of "Metglas" ductile amorphous metal produced by Allied Corporation of Morris Township, N.J., was subjected to the same levels of excitation, also at 60 Hz, and the resulting pulses are plotted in FIGS. 7A, 7B, 7C and 7D. The "Metglas" ribbon was 0.070" wide, 0.0007" thick, and 3.0" long. It was identified as "Metglas" strip/2826MB2, having a maximum permeability of 180,000, a coercivity, $H_c$, of 0.035 oersteds, and a saturation magnetization of 9,000 Gauss.

Before discussing in further detail the wave shapes shown in FIGS. 6 and 7 and their implication with regard to an article surveillance system, it will be useful to have an understanding of the present invention and the pulse forms thereby obtainable. Referring to FIG. 3, there is shown a marker 20 having a substrate 21 and an overlayer 22 that can be the same as the components 11 and 12, respectively, in FIG. 1, and can be attached to an article in similar fashion. However, instead of the ribbon 13, the active element in the embodiment of FIG. 3 is a length of amorphous metal wire 23. A sample used to provide the test data to be discussed was approximately 7.6 cm (3") long, had a diameter of 0.125 mm, and its composition essentially satisfied the formula $Fe_{81}$ $Si_4$ $B_{14}$ $C_1$, where the percentages are in atomic percent. These parameters should be considered only as representing one example for the purpose of explanation since, as will appear from the ensuing discussion, the diameter can range between 0.09 and 0.15 mm while the length can range between about 2.5 and 10 cm for use as a surveillance marker. The demagnetizing factor for the length of wire, 23, preferably does not exceed 0.000125. At present, however, the dimensions of the above sample are preferred for the wire 23.

What has been described so far is not unusual, but the particular wire used for the element 23 is unique in that it is characterized by a discontinuous hysteresis characteristic. Not by a slight discontinuity, but by a large Barkhausen discontinuity such that when the magnitude of an incident field of appropriate direction relative to the magnetic polarity of the wire exceeds a low threshold value, in this case substantially less than 1.0 oersted, the magnetic polarity of the wire will reverse regeneratively, independent of any further increase in the incident field, up to its maximum induction point. The threshold for the above sample is actually less than 0.6 oersted.

The nature of the hysteresis loop is shown in FIG. 4. Again, the scale and proportions in FIG. 4 are grossly distorted from reality for the sake of convenience in explanation. Thus, the magnetizing field from the negative residual induction point 24 to the threshold point 25 is less than 1.0 oersted. Once the magnetizing field exceeds the threshold value for the sample, there occurs an abrupt regenerative reversal of the polarity, represented by the broken line segment 26 of the hysteresis loop, until the maximum induction point 27 is reached. If the magnetizing field continues to increase above the threshold point, the flux density will increase toward the positive saturation point 28. Otherwise, the element 23 will head toward its positive residual induction point 29 as the magnitude of the magnetizing field approaches zero, and will remain there until the magnetizing field departs from zero. If the magnetizing field now increases in the negative direction, the flux density will follow the stable portion of the loop to the negative threshold point 30 from which it shifts regeneratively and substantially instantaneously along the broken line segment 31 to the negative maximum induction point 32 and then to a point between saturation at 33 and threshold 25 as a function of the magnetizing field.

It should now be apparent that change in the magnetic polarity of the wire 23 between either points 25 and 27 or 30 and 32 occurs independent of the rate of change of the magnetizing field. All that is important is that the magnetizing field exceed the threshold level of the particular wire element 23. This fact is borne out by the pulse forms obtained from the wire 23 under different levels of field excitation which pulse forms are shown in FIG. 8. While there is some difference between the sharpness or time duration of the signal spikes such differences are slight when a comparison is made with FIGS. 6 and 7 showing the pulses from prior art marker strips.

The above-mentioned sample of wire 23 was 7.6 cm. long. It has been found that varying the length over the mentioned range will influence the hysteresis loop by changing the slope of the portions 28-30 and 33-25, shown in solid lines. As the wire is made shorter, the aforementioned slope will increase, while as the wire is made longer, the slope in question will decrease. Changing the aforesaid slope will alter the sharpness of the pulse. Thus, if a longer wire 23 can be tolerated and it is so desired, the differences between the pulses in the various parts of FIG. 8 can be reduced. However, it is generally the sensitivity and selectivity of the surveillance system in which the marker is to operate that determines what pulse wave shapes can be tolerated and that imposes a limit on the minimum length of wire. The wire 23 must be long enough to produce a pulse with sufficient definition that it can be detected by the detecting system.

While the pulses illustrated in FIG. 7 were from a test sample of amorphous metal, it did not have a Barkhausen discontinuity, and a comparison with the pulses in FIG. 8, also from an amorphous metal but with a Barkhausen discontinuity, reveals a profound difference. The significant change in pulse width shown in FIG. 7 and the very close mimicking of the permalloy sample as the excitation is increased from 1.2 to 4.5 oersteds is but an indication that the "Metglas" sample did not have a Barkhausen discontinuity in its hysteresis characteristic. By contrast, FIG. 8 reveals the presence of a Barkhausen discontinuity, which is necessary, at the specified levels and frequency of the exciting field, to give rise to the extremely short duration pulses with comparatively little change in width over the exciting range.

The invention is not limited to a wire marker. Instead, it encompasses any body of magnetic material having a large Barkhausen discontinuity in its hysteresis loop associated with a relatively low switching threshold, preferably no greater than about 1.0 oersted. For example, similar results can be obtained if the same material from which wire 23 was produced is used to produce a ribbon of amorphous metal such as shown in FIG. 5. The ribbon designated 35 in FIG. 5, can be produced by any known method for rapidly quenching molten metal to avoid crystallization. Starting with a ribbon about 2 mm wide and about 0.025 mm thick between 3 and 10 cm long, it should be twisted up to 4 turns per 10 cm and annealed while so twisted, the annealing being performed at about 380° C. for about 25 minutes. When cool, the ribbon should be untwisted and laminated within substrate and overlayer in a flat condition similar to that shown in FIG. 1. The flattened ribbon will have locked in stresses providing a helical easy axis of magnetization and giving rise to the subject discontinuities. In other words, the ribbon or strip should have stress induced magnetic discontinuity when restrained in flattene condition.

Figure 9:
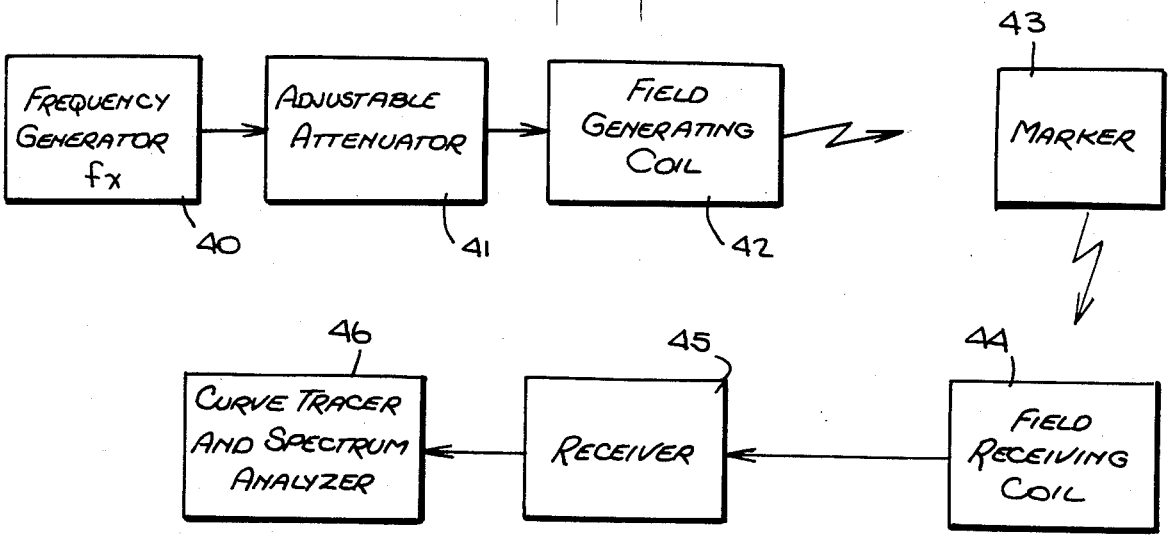
FIG. 9 is a block diagram of the test equipment utilized to produce the curves of FIGS. 6, 7, 8 and 14, as well as the spectrograms of FIGS. 10, 11 and 12.
Figure 14:
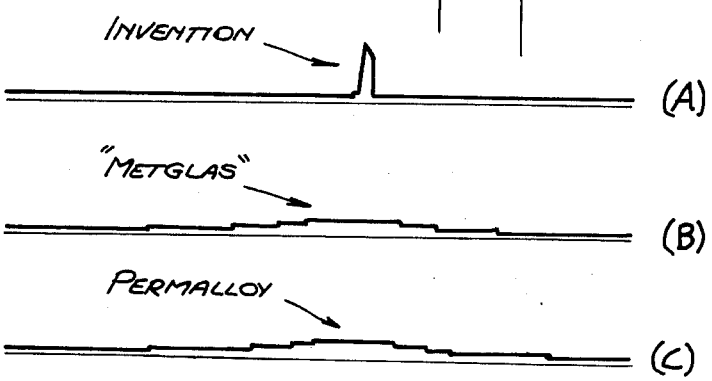
FIGS. 14A–14D are a series of three curves showing and comparing the pulse response to an external excitation, at a frequency of 20 Hz and a level of 1.2 oersteds, of the permalloy, "Metglas", and invention markers whose response at 60 Hz is shown in FIGS. 6, 7 and 8.

In order to understand the implication of using the above described markers, having large hysteresis loop Barkhausen discontinuities, in an article surveillance system, it is helpful to examine the frequency spectra of the pulse signals obtained from such markers. For this purpose a testing system was assembled as shown in FIG. 9. An adjustable frequency generator or source 40 was connected through an adjustable attenuator 41 to a field generating coil 42. With this arrangement a magnetizing field could be established within a controlled space having a desired frequency and field strength. By appropriate calibration and metering (not shown) known levels of excitation were obtainable at the position of the marker 43. Any stimulation of the marker 43 resulting in field perturbation was detected by a suitable field receiving coil 44 whose output was coupled through a receiver 45 to a curve tracer and spectrum analyzer 46. This system was used to produce the curves in FIGS. 6, 7, 8 and 14 as well as the spectrograms of FIGS. 10 to 12.

Figure 10:
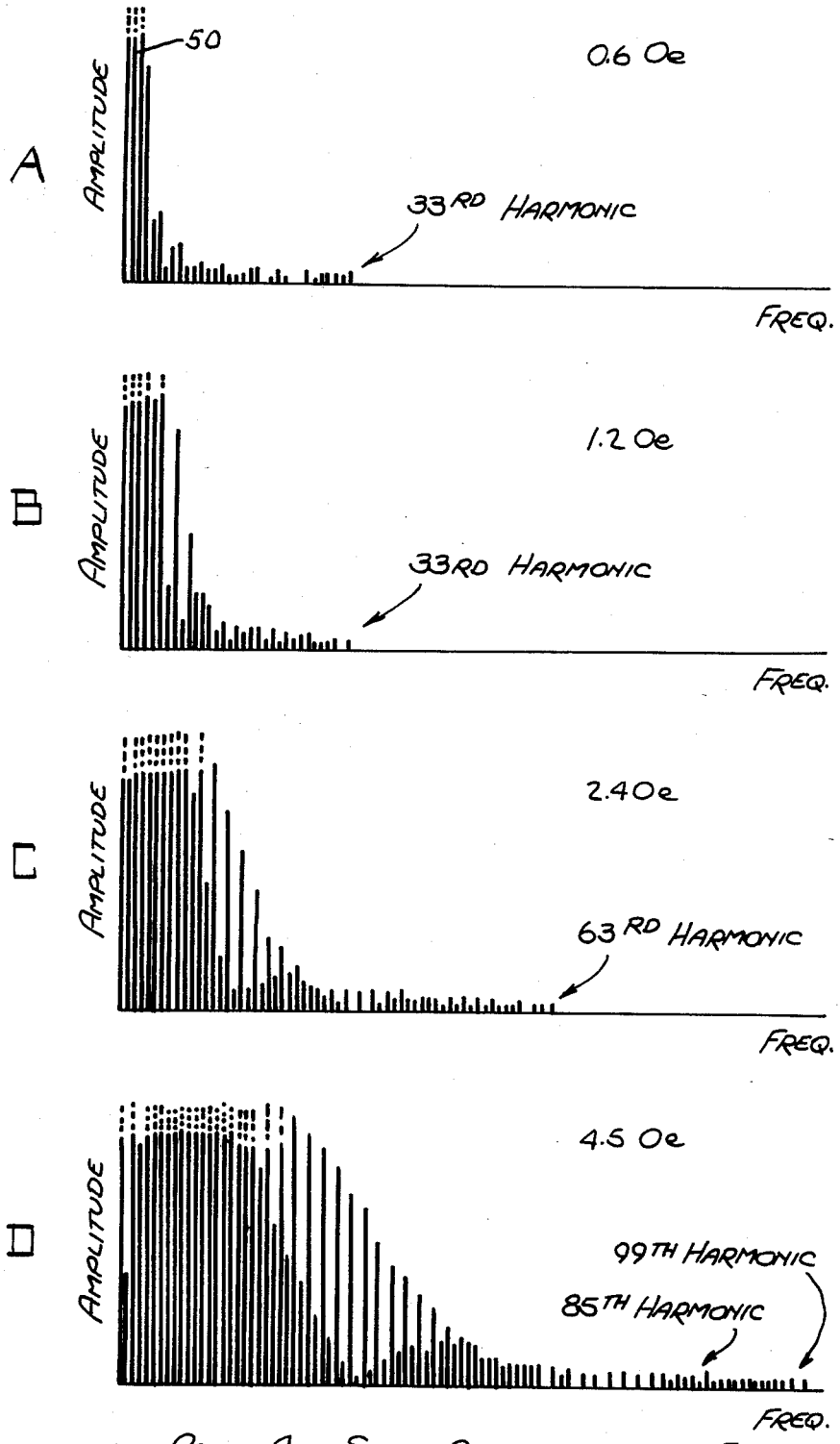
FIGS. 10A–10D are a series of four spectrograms presenting the frequency content of the signal obtained from a prior art marker exposed to an incident field at 60 hertz and field strength of 0.6, 1.2, 2.4 and 4.5 oersteds.
Figure 11:
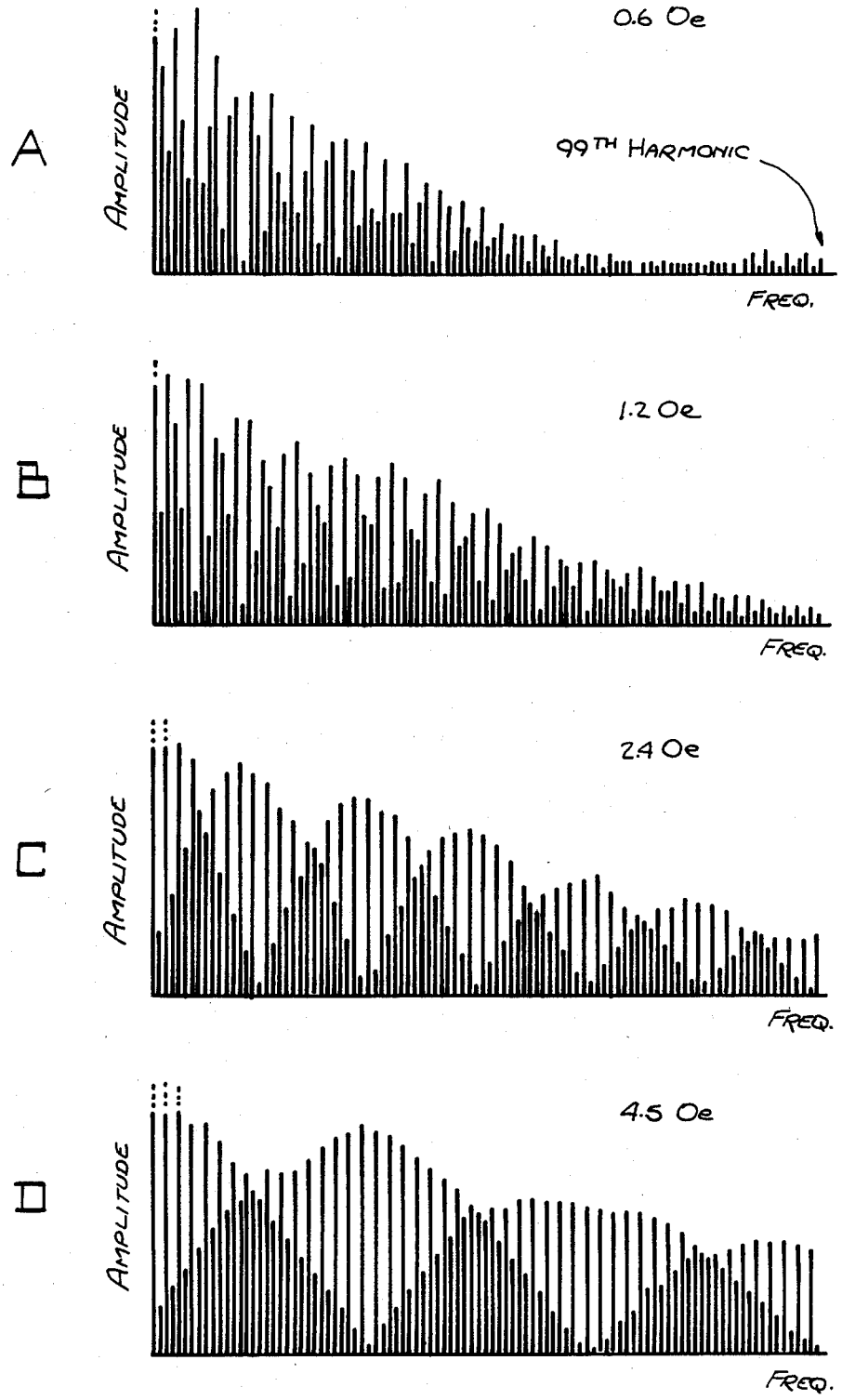
FIGS. 11A–11D are a series of four spectrograms showing the frequency content of the signal obtained from the markers of the invention when exposed to the same levels of excitation as in FIG. 10.
Figure 12:
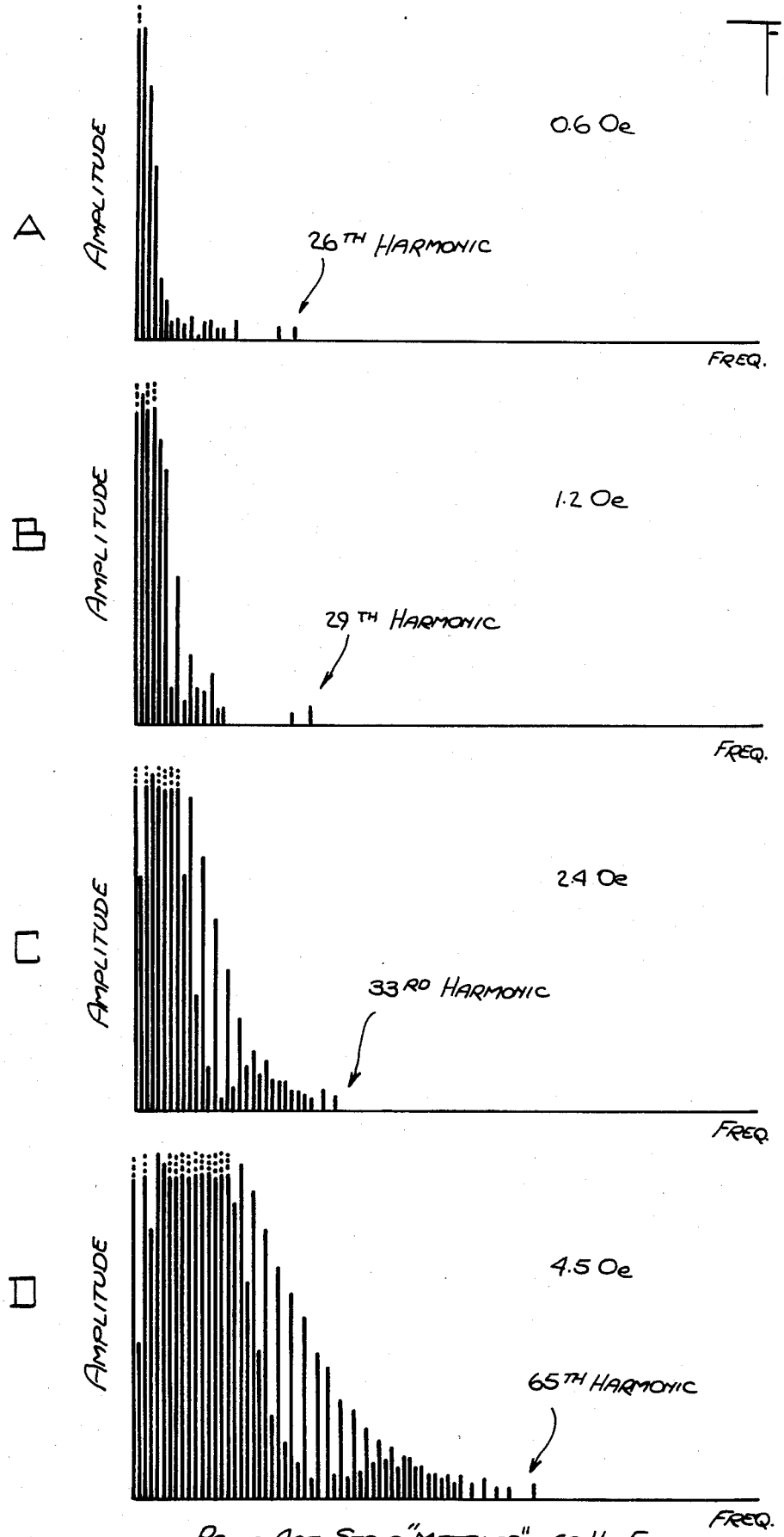
FIGS. 12A–12D are similar to FIG. 10, but showing the response of a "Metglas" ribbon to the same four excitation levels.

Referring now to FIGS. 10 to 12, they constitute spectrograms of the pulse trains obtained from the prior art markers and a marker according to the invention when such markers were excited by magnetizing fields of fixed frequency (60 Hz) and various levels of field excitation. The frequency of the harmonic component is plotted along the x-axis while the peak amplitude of the harmonic is plotted along the y-axis. However, the x-axis has a zero offset with the origin corresponding to 60 Hz, the fundamental frequency, so that the first component to the right, designated by the numeral 50 in FIG. 10A, corresponds to the 2nd harmonic at 120 Hz. A series of dots above a bar line signifies that the amplitude exceeded the range covered by the graph.

If FIG. 10 is examined, it reveals how field strength dependent is the output from prior art permalloy strip markers. The same marker element was used for these spectrograms as was described with reference to FIG. 6. Thus, when subjected to 0.6 oersted field excitation the permalloy strip produced a pulse in which the 33rd harmonic was the highest detectable with sufficient amplitude not to be masked by background noise in a surveillance system. At an excitation of 1.2 oersted as shown in FIG. 10B, the 33rd harmonic is still the highest detectable, although there is a stronger presence of the low order harmonics. The magnitude of the 33rd harmonic, however, has remained essentially the same as at the lower 0.6 oersted excitation. The 63rd harmonic is noticeable at 2.4 oersteds (FIG. 10C), while at an excitation of 4.5 oersteds (FIG. 10D) the 99th harmonic is beginning to appear.

Figure 13:
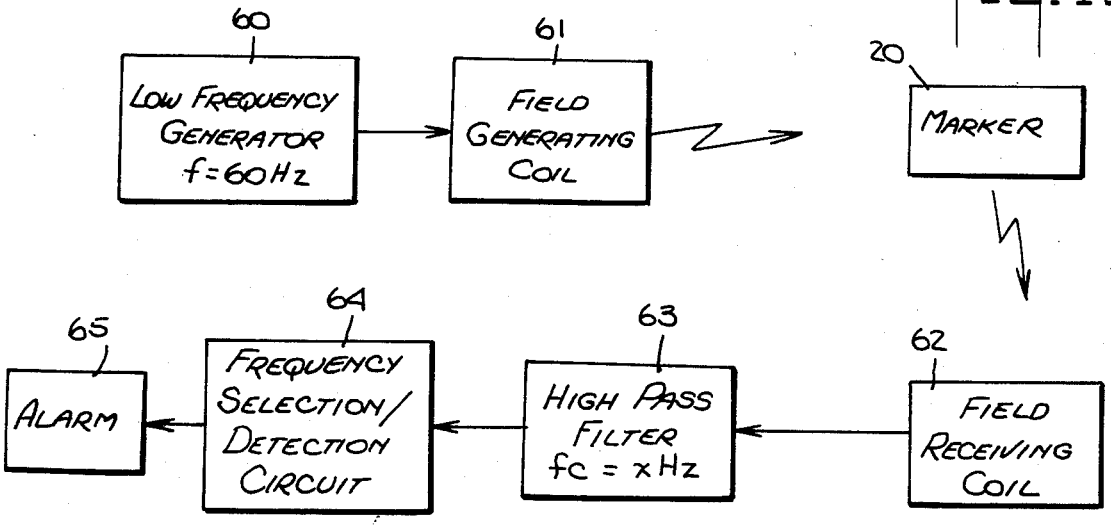
FIG. 13 is a block diagram of a typical system for establishing a surveillance field and detecting the markers of the invention.

Now, compare with FIG. 10 the corresponding spectrograms for the marker according to the invention as shown in FIG. 11. With the invention, at every level of excitation, from 0.6 oersted on up, harmonics on out as far as the 99th harmonic are present with significant amplitude to be readily detectable. Whether the pulse envelopes of FIG. 8 are compared with those of FIG. 6, or the spectrograms of FIG. 11 are compared with those of FIG. 10, the differences are readily perceived. With the invention, a broad band of higher order harmonics appears at a relatively low level of magnetizing field excitation, an excitation level below that level at which prior art permalloy strips produce any significant detectable output. Consequently, a detection system can be assembled to detect the new marker without interference by permalloy strips or any other similar prior art marker. An example of a system is shown in FIG. 13 wherein a low frequency generator 60 of 60 Hz signal drives a field generating coil 61. When a marker 20 is in the field from coil 61, its perturbations are received by a field receiving coil 62 whose output is passed through a high pass filter circuit 63 having a suitable cutoff frequency. Signals passed by filter 63 are supplied to a frequency selection/detection circuit 64. Depending upon the screen provided in circuit 64, when a predetermined pattern of frequency, amplitude and/or pulse duration is detected, the circuit 64 will furnish an output to activate an alarm 65. From a consideration of the graphs of FIGS. 10 and 11 it should be evident that the unique markers according to the invention can be detected by systems that can be made immune to permalloy strips. Also, from a consideration of FIG. 11, it should be evident that the response of the invention marker is detectable over a wide range of magnetizing field strength.

Referring now to FIG. 12, there is shown the corresponding frequency spectra that was obtained from the "Metglas" ductile amorphous metal sample. At an excitation of 0.6 oersteds the highest order harmonic detectable with any significant amplitude is the 26th. At 1.2 oersteds excitation the 29th harmonic has appeared, while the 33rd harmonic first appears at 2.4 oersted excitation. At the maximum excitation of 4.5 oersteds, the highest noticeable harmonic is the 65th. The overall spectral pattern bears an extremely close resemblance to that shown in FIG. 10 for permalloy, and cannot be mistaken for the drasticall different spectrum shown in FIG. 11 for the invention.

The dependency of prior art markers on time rate of change of the incident field has led prior workers in the article surveillance field toward the use of higher and higher frequencies. However, because of the unique qualities of the markers according to the invention, there is an advantage to be obtained from resorting to lower rather than higher excitation frequencies. This follows from the fact that since the subject markers are relatively insensitive to the rate of change of the incident field, the subject markers respond well to very low frequency excitation. However, the low frequency, coupled with the same low field strengths as used heretofore, gives rise to smaller rather than larger rates of change of field, and this causes responses from permalloy or other similar magnetic marker materials to become less rather than more readily detectable. In this connection, it has been found that the wire marker described above with reference to FIG. 3 will produce a signal pulse of less than 400 μSec. duration when excited by a 1.2 Oe field at 20 Hz. This pulse is rich in harmonics. See the comparison shown in FIG. 14. Consequently, the wire of the invention is easily detected while prior art markers are essentially invisible to the same interrogation field.

Amorphous metal has been known, as previously mentioned. However, to the extent that information is available, it has been uniform practice by the manufacturers of surveillance marker material to subject the metal to a final annealing step, probably with the assumption that mechanical parameters would be improved. However, it has been discovered that such annealing eliminates any large Barkhausen discontinuities that might have existed in the hysteresis loop of the element. It has now been discovered that amorphous metal wire, obtained directly from the rapid quench of molten metal and having the dimensions previously mentioned, will have the described discontinuous hysteresis loop. But if such samples are annealed, the material loses its magnetic discontinuities.

By way of summary, for the purpose of providing an element useful as an article survcillance marker, in accordance with the present invention, the element should have a large Barkhausen discontinuity in its hysteresis loop. Such discontinuity should respond to a low level of field excitation, preferably below 1.0 oersted, and should result in a reversal of magnetic polarization from the threshold excitation point to the maximum induction point for the element, or at least close to such maximum induction point. The element should be positive magnetostrictive. Finally, the geometry of the element should be such as to limit the demagnetizing factor to a very low level, preferably not in excess of 0.000125. While amorphous metal is presently preferred, the invention contemplates use of any material with which the mentioned performance parameters can be obtained.

Satisfactory results have been obtained with amorphous wire markers having the following compositions:

(a) $Fe_{81}\ Si_4\ B_{14}\ C_1$;

(b) $Fe_{81}\ Si_4\ B_{15}$; and (c) $Fe_{77.5}\ Si_{7.5}\ B_{15}$.

However, it is believed that a wide range of such materials can be used, all falling within the general formula:

$$Fe_{85-x}Si_xB_{15-Y}C_y,$$

where the percentages are in atomic percent, x ranges from about 3 to 10, and y ranges from about 0 to 2.

Having described the present invention with reference to the presently preferred embodiments thereof, it should be understood that various changes can be made without departing from the true spirit of the invention as defined in the appended claims.

What is claimed is:

1. A marker for use in an article surveillance system in which an alternating magnetic field is established in a surveillance region and an alarm is activated when a predetermined perturbation to said field is detected, said marker comprising a body of magnetic material with retained stress and having a magnetic hysteresis loop with a large Barkhausen discontinuity such that exposure of said body to an external magnetic field, whose field strength in the direction opposing the magnetic polarization of said body exceeds a predetermined threshold value, results in regenerative reversal of said magnetic polarization, and means for securing said body to an article to be maintained under sureveillance.

2. A marker according to claim 1, characterized in that said body comprises a length of amorphous metal wire.

3. A marker according to claim 2, characterized in that said wire has a diameter within the range of 0.09 to 0.15 mm and a length within the range of 1 to 10 cm.

4. A marker according to claim 3, characterized in that the demagnetizing factor for said length of wire does not exceed 0.000125.

5. A marker according to claim 3, characterized in that said wire has a diameter of approximately ⅛ millimeter.

6. A marker according to claim 5, characterized in that said wire is approximately 7.6 cm long.

7. A marker according to claim 3, characterized in that said wire is approximately 7.6 cm long.

8. A marker according to claim 2, characterized in that the demagnetizing factor for said length of wire does not exceed 0.000125.

9. A marker according to claim 2, characterized in that the metallurgical composition of said wire is essentially given by the formula $Fe_{81}Si_4B_{14}C_1$, where the percentages are in atomic percent.

10. A marker according to claim 9, characterized in that said wire has a diameter within the range of 0.09 to 0.15 mm and a length within the range of 1 to 10 cm.

11. A marker according to claim 10, characterized in that the demagnetizing factor for said length of wire does not exceed 0.000125.

12. A marker according to claim 2, characterized in that the metallurgical composition of said wire is essentially given by the formula $Fe_{85-x}\ Si_x\ B_{15-y}\ C_y$, where the percentages are in atomic percent, x ranges from about 3 to 10, and y ranges from about 0 to 2.

13. A marker according to claim 12, characterized in that $x=4$ and $y=0$.

14. A marker according to claim 12, characterized in that $x=7.5$ and $y=0$.

15. A marker according to claim 1, characterized in that said body comprises a length of amorphous metal ribbon supported in a magnetic Barkhausen discontinuity inducing strained condition.

16. A marker according to claim 15, characterized in that said ribbon when restrained in a flat position has a helical easy axis of magnetization resulting from annealing said ribbon while twisted to relax helical stresses resulting from said twisting and thereafter untwisting.

17. A marker according to claim 16, characterized in that said length of ribbon is about 0.025 mm thick, about 2 mm wide, and 3 to 10 cm long.

18. A marker according to claim 15, characterized in that said length of ribbon is about 0.025 mm thick, about 2 mm wide, and 3 to 10 cm long.

19. A marker according to claim 1, characterized in that the perturbation accompanying said regenerative reversal of said magnetic polarization is in the form of a pulse having a duration of less than about 400 μSec.

when said body is exposed to a magnetic field of about 1.2 oersteds at 20 hertz.

20. A marker according to claim 1, characterized in that said predetermined threshold value is no greater than 1.0 oersted.

21. A marker according to claim 1, characterized that said body comprises a length of amorphous metal wire which, due to its manufacturing history, contains locked in strain giving rise to said large Barkhausen discontinuity in said hysteresis loop.

22. A marker according to claim 21, characterized in that said wire has a diameter within the range of 0.09 to 0.15 mm and a length within the range of 1 to 10 cm.

23. A marker according to claim 22, characterized in that said wire has a diameter of approximately $\frac{1}{8}$ millimeter.

24. A marker according to claim 23, characterized in that said wire is approximately 7.6 cm long.

25. A marker according to claim 21, characterized in that the metallurgical composition of said wire is essentially given by the formula $Fe_{85-x}Si_xB_{15-y}C_y$, where the percentages are in atomic percent, x ranges from about 3 to 10, and y ranges from about 0 to 2.

26. A marker according to claim 25, characterized in that x=4 and y=0.

27. A marker according to claim 25, characterized in that x=7.5 and y=0.

28. A marker according to claim 25, characterized in that x=4 and y=1.

29. A marker according to claim 1, in combination with a low frequency generator, a field generating coil assembly coupled to an output of said generator, a field receiving coil, a high pass filter, and means coupled to an output of said filter for detecting the presence of a series of frequency components above a predetermined frequency and above a pre-set amplitude for activating an alarm.

30. A marker according to claim 15, characterized in that the metallurgical composition of said ribbon is essentially given by the formula $Fe_{85-x}Si_xB_{15-y}C_y$, where the percentages are in atomic percent, x ranges from about 3 to 10, and y ranges from about 0 to 2.

31. A marker according to claim 30, characterized in that x=4 and y=0.

32. A marker according to claim 30, characterized in that x=7.5 and y=0.

33. A marker according to claim 30, characterized in that x=4 and y=1.

34. A marker for use in an article surveillance system in which an alternating magnetic field is established in a surveillance region and an alarm is activated when a predetermined perturbation to said field is detected, said marker comprising a body of magnetic material characterized in that the magnetic polarity thereof commences and completes reversal when the magnitude of strength of said field attains a given value, without need for increase in field strength above said given value.

35. A method for detection of the presence of an article in an interrogation zone comprising the steps of:

a. generating an incident alternating low frequency magnetic field within an interrogation zone;

b. securing a marker to an article, said marker being selected to comprise a body of magnetic material with retained stress and having a magnetic hysteresis loop with a large Barkausen discontinuity such that upon exposure of said body to an external magnetic field, whose field strength in the direction opposing the magnetic polarization of said body exceeds a given threshold value, there results a regenerative reversal of said magnetic polarization; and c. detecting perturbations of the magnetic field in said interrogation zone having a frequency higher than the 30th harmonic of the incident alternating low frequency magnetic field when said marker is present in said interrogation zone.

36. The method of claims 35 wherein perturbations in excess of the seventy-fifth harmonic of the incident alternating low frequency magnetic field are detected in said step c.

37. The method of claim 35 wherein perturbations in excess of the ninetieth harmonic of the incident alternating low frequency magnetic field are detected in said step c.

38. The method of claim 35 wherein said incident alternating low frequency magnetic field is selected at a frequency of less than 100 hertz, and wherein perturbations of the magnetic field in excess of the thirtieth harmonic of incident magnetic field frequency are detected in said step c.

39. The method of claim 38 wherein the lowest intensity of the magnetic field in the interrogation zone is selected to be less than 1.2 oersted.

40. An article surveillance system for detection of the presence of an article in an interrogation zone comprising:

a. low frequency generator means for generating an incident alternating low frequency magnetic field within an interogation zone having a magnetic field intensity throughout said interrogation zone in excess of a predetermined threshold value;

b. a marker secured to an article, said marker comprising a body of magnetic material with retained stress and having a magnetic hysteresis loop with a large Barkhausen discontinuity such that upon exposure of said body to an external magnetic field, whose field strength in the direction opposing the instaneous magnetic polarization of said body exceeds said predetermined threshold value, there results a regenerative reversal of said magnetic polarization;

c. receiving means for detecting perturbations of the magnetic field in said interrogation zone having a frequency higher than the 30th harmonic of the incident alternating low frequency magnetic field when said marker is present in said interrogation zone.

41. The article surveillance system of claims 40 wherein the marker produces detectable perturbations in excess of the seventy-fifth harmonic of the incident alternating low frequency magnetic field.

42. The article surveillance system of claim 40 wherein the marker produces detectable perturbations in excess of the ninetieth harmonic of the incident alternating low frequency magnetic field.

43. The article surveillance system of claim 40 wherein the incident alternating low frequency magnetic field operates at a frequency of less than about 100 hertz, and the receiving means detects perturbations of the magnetic field in excess of the thirtieth harmonic of incident magnetic field frequency.

44. The article surveillance system of claim 43 wherein the lowest intensity of the magnetic field in the interrogation zone is less than about 1.2 oersteds.

* * * * *